US011837191B2

(12) United States Patent
Han et al.

(10) Patent No.: US 11,837,191 B2
(45) Date of Patent: *Dec. 5, 2023

(54) DISPLAY DRIVER INTEGRATED CIRCUIT AND DISPLAY DEVICE INCLUDING THE SAME

(71) Applicant: SAMSUNG DISPLAY CO., LTD., Yongin-si (KR)

(72) Inventors: Ho Seok Han, Yongin-si (KR); Hyun Gu Kim, Yongin-si (KR); Jun Yong Park, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/389,733

(22) Filed: Jul. 30, 2021

(65) Prior Publication Data

US 2021/0358449 A1 Nov. 18, 2021

Related U.S. Application Data

(63) Continuation of application No. 16/936,745, filed on Jul. 23, 2020, now Pat. No. 11,081,080, which is a (Continued)

(30) Foreign Application Priority Data

Nov. 6, 2017 (KR) ..... 10-2017-0146714

(51) Int. Cl.
*G09G 5/00* (2006.01)
*G09G 3/3258* (2016.01)

(52) U.S. Cl.
CPC ..... *G09G 5/005* (2013.01); *G09G 3/3258* (2013.01); *G09G 5/006* (2013.01); (Continued)

(58) Field of Classification Search
None
See application file for complete search history.

(56) References Cited

U.S. PATENT DOCUMENTS 8,184,026 B2 5/2012 Kim et al.
9,325,314 B2 4/2016 Shin
(Continued)

FOREIGN PATENT DOCUMENTS

CN 103871458 A 6/2014
CN 104679546 A 6/2015
(Continued)

OTHER PUBLICATIONS

MIPI Alliance, MIPI Alliance Specification for D-PHY, May 14, 2009, pp. 1-124, Mipi mobile industry processor interface.
(Continued)

*Primary Examiner* — Yanna Wu
(74) *Attorney, Agent, or Firm* — CANTOR COLBURN LLP

(57) ABSTRACT

A display device includes: a host which transmits a first signal through a first interface, and transmits a second signal through a second interface different from the first interface; a display driver integrated circuit including a first interface unit which receives the first signal through the first interface, and a second interface unit which receives the second signal through the second interface; and a display panel which receives a data signal corresponding to the first signal and the second signal from the display driver integrated circuit, and displays an image.

19 Claims, 4 Drawing Sheets

Related U.S. Application Data continuation of application No. 16/054,361, filed on Aug. 3, 2018, now Pat. No. 10,726,808.

(52) U.S. Cl.
CPC . *G09G 2310/0281* (2013.01); *G09G 2310/08* (2013.01); *G09G 2370/04* (2013.01); *G09G 2370/045* (2013.01); *G09G 2370/08* (2013.01)

(56) References Cited

U.S. PATENT DOCUMENTS

| | | | | |
|---|---|---|---|---|
| 9,485,381 | B1 | 11/2016 | Hunter | |
| 9,769,417 | B1 * | 9/2017 | Yarygin | G09G 5/006 |
| 9,805,687 | B2 | 10/2017 | Han | |
| 10,542,242 | B2 | 1/2020 | Lim et al. | |
| 2013/0057763 | A1 | 3/2013 | Cha et al. | |
| 2014/0184828 | A1 | 7/2014 | Chartrand | |
| 2015/0061981 | A1 | 3/2015 | Lee et al. | |
| 2016/0063948 | A1 | 3/2016 | Han | |
| 2016/0109934 | A1 * | 4/2016 | Woo | G06F 1/3265 345/211 |
| 2017/0124957 | A1 | 5/2017 | Ahn et al. | |
| 2017/0150231 | A1 * | 5/2017 | Brulotte | H04N 21/2353 |
| 2017/0286327 | A1 * | 10/2017 | Zhang | G06F 13/4068 |
| 2018/0018932 | A1 * | 1/2018 | Atkins | G09G 5/005 |

FOREIGN PATENT DOCUMENTS

| | | | |
|---|---|---|---|
| KR | 1020160028622 | A | 3/2016 |
| KR | 1020160046620 | A | 4/2016 |
| KR | 1020160097022 | A | 8/2016 |
| WO | 2017057926 | A1 | 4/2017 |

OTHER PUBLICATIONS

Chinese Office Action dated Jan. 28, 2023 with respect to the Chinese Patent Application No. 201811311650.2 filed on Nov. 6, 2018; 8 pages.

* cited by examiner

DISPLAY DRIVER INTEGRATED CIRCUIT AND DISPLAY DEVICE INCLUDING THE SAME

This application is a continuation of U.S. patent application Ser. No. 16/936,745, filed on Jul. 23, 2020, which is a continuation of U.S. patent application Ser. No. 16/054,361, filed on Aug. 3, 2018, which claims priority to Korean Patent Application No. 10-2017-0146714, filed on Nov. 6, 2017, and all the benefits accruing therefrom under 35 U.S.C. § 119, the content of which in its entirety is herein incorporated by reference.

BACKGROUND

1. Field

Embodiments of the disclosure relate to a display driver integrated circuit and a display device including the display driver integrated circuit.

2. Description of Related Art

With improvement in performance and resolution of components such as display devices and image sensors included in mobile devices or the like, the amount of transmission data is rapidly increasing.

Development of the mobile devices leads to an increase in the number of internal lines and an increase in electromagnetic interference ("EMI"). Accordingly, research on a serial interface such as a mobile industry processor interface ("MIPI") or a mobile display digital interface ("MDDI") has become appreciably more active to reduce the number of internal lines and EMI.

SUMMARY

The mobile display digital interface ("MDDI") is an interface which is currently widely used in a mobile display device having resolutions of nHD (360×640) or more. With the development of a display manufacturing technology, various types of data transmission are desired. However, MIPI Alliance has not presented measures for efficiently transmitting data having a type other than data types specified in the MIPI.

Various embodiments of the disclosure are directed to a display driver integrated circuit with improved communication function with a host and provided in a display device including the display deriver integrated circuit.

An embodiment of the disclosure provides a display device including: a host which transmits a first signal through a first interface, and transmits a second signal through a second interface different from the first interface; a display driver integrated circuit including a first interface unit which receives the first signal through the first interface, and a second interface unit which receives the second signal through the second interface; and a display panel which receives a data signal corresponding to the first signal and the second signal from the display driver integrated circuit, and displays an image.

In an embodiment, the second signal may include metadata.

In an embodiment, the first interface may be operated in a mobile industry processor interface ("MIPI") scheme.

In an embodiment, the first interface unit may include a clock lane module which receives a clock signal, and a data lane module which receives a data signal.

In an embodiment, the second interface unit may include a metadata lane module which receives a metadata signal.

In an embodiment, the metadata lane module may include a high-speed receiver.

In an embodiment, the metadata lane module may include a low-power receiver.

In an embodiment, the second interface may be operated in a serial programming interface ("SPI") scheme.

In an embodiment, the second interface may be operated in an inter integrated circuit ("I2C") scheme.

In an embodiment, the host may transmit metadata among high dynamic range ("HDR") image data through the second interface, and transmit remaining data other than the metadata among the HDR image data through the first interface.

An embodiment of the disclosure provides a display driver integrated circuit including: a first interface unit which receives a first signal from a host in a MIPI scheme; and a second interface unit which receives a second signal from the host in an interface scheme different from the MIPI scheme. In such an embodiment, the second signal may include metadata.

In an embodiment, the first interface unit may include a clock lane module which receive a clock signal, and a data lane module which receive a data signal. In such an embodiment, the second interface unit may include a metadata lane module which receives a metadata signal.

In an embodiment, the metadata lane module may include a high-speed receiver.

In an embodiment, the metadata lane module may include a low-power receiver.

In an embodiment, the second interface unit may receive metadata among HDR image data. In such an embodiment, the first interface unit may receive remaining data other than the metadata among the HDR image data

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
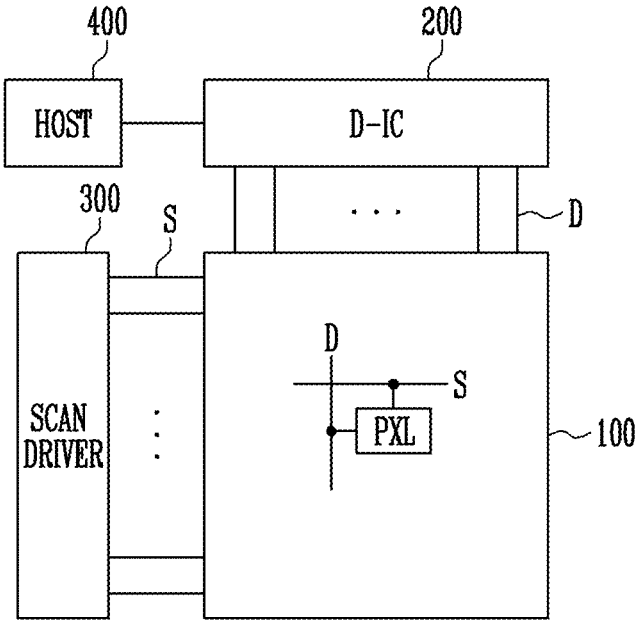
FIG. 1 is a schematic diagram illustrating a display device in accordance with an embodiment of the disclosure.

The invention will now be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It is also noted that in this specification, "connected/coupled" refers to one component not only directly coupling another component but also indirectly coupling another component through an intermediate component. On the other hand, "directly connected/directly coupled" refers to one component directly coupling another component without an intermediate component.

Hereinafter, embodiments of a display driver integrated circuit and a display device including the display driver integrated circuit according to the invention will be described in detail with reference to the accompanying drawings.

FIG. 1 is a schematic diagram illustrating a display device in accordance with an embodiment of the disclosure.

An embodiment of the display device may be a mobile device. The mobile device may be embodied in a cellular phone, a smartphone, a table personal computer ("PC"), a personal digital assistant ("PDA"), an enterprise digital assistant ("EDA"), a digital still camera, a digital video camera, a portable multimedia player ("PMP"), a personal navigation device or portable navigation device ("PND"), a mobile internet device ("MID"), or a wearable computer, for example.

Referring to FIG. 1, an embodiment of the display device may include a display panel 100, a display driver integrated circuit 200, a scan driver 300 and a host 400.

The display panel 100 may include pixels PXL that are coupled with data lines D and scan lines S. Each of the pixels PXL may emit light having a luminance corresponding to a data signal supplied thereto through the data lines D.

In an embodiment where the display device is an organic light-emitting display device, each of the pixels PXL may include an organic light-emitting diode (not shown), and a pixel circuit (not shown) configured to control the amount of current flowing to the organic light-emitting diode.

In such an embodiment, the pixel circuit may include a plurality of transistors including a driving transistor and a switching transistor.

In such an embodiment, each pixel PXL may be supplied with a data signal from the corresponding data line D when the switching transistor is turned on in response to a scan signal supplied to the corresponding scan line S. Thereafter, the driving transistor included in the pixel PXL may supply current corresponding to the data signal to the organic light-emitting diode, whereby the organic light-emitting diode may generate light having a luminance corresponding to the current.

In an alternative embodiment where the display device is a liquid crystal display device, each of the pixels PXL may include a switching transistor (not shown) and a liquid crystal capacitor (not shown). Each pixel PXL may be selected or turned on when a scan signal is supplied to a corresponding scan line S thereof, and be supplied with a data signal from a corresponding data line D thereof. Thereafter, the pixel PXL may control the transmissivity of the liquid crystal in response to the data signal so that light having a luminance corresponding to the transmittance of the liquid crystal is emitted.

The display driver integrated circuit 200 may control the overall operation of the display panel 100. In an embodiment, the display driver integrated circuit 200 may include a data driver (not shown) configured to output a data voltage.

The scan driver 300 may supply scan signals to the scan lines S. In one embodiment, for example, the scan driver 300 may sequentially supply the scan signals to the scan lines S. In such an embodiment, the pixels PXL may be selected on a horizontal-line-by-horizontal-line basis.

In an embodiment, the scan driver 300 may be mounted in the form of a chip on a peripheral region of the display panel 100. Alternatively, the scan driver 300 may be integrated on the peripheral region through a same manufacturing process as that of the pixels PXL.

The host 400 may generate and output a plurality of data signals, a plurality of clock signals, etc. for driving the display driver integrated circuit 200. The host 400 may be a system-on-chip ("SOC") formed by integrating various components on a single chip, or an application processor ("AP") chip.

Figure 2:
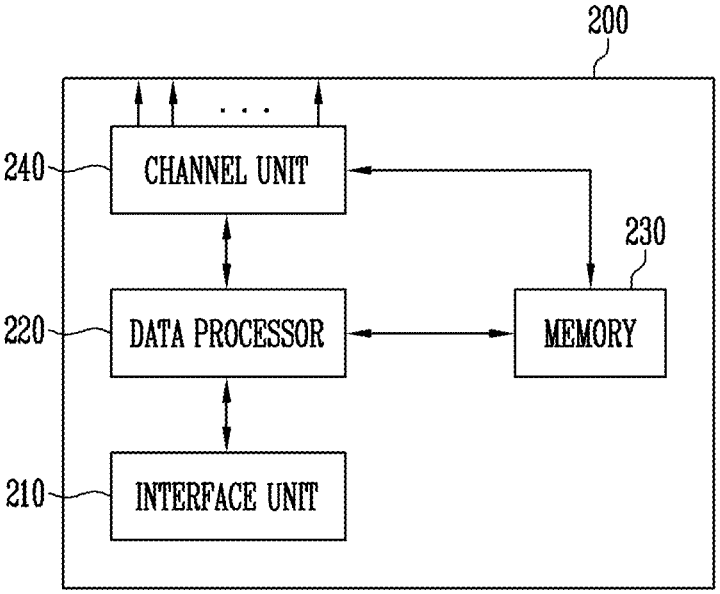
FIG. 2 is a schematic diagram illustrating an embodiment of a display driver integrated circuit shown in FIG. 1.

FIG. 2 is a schematic diagram illustrating an embodiment of the display driver integrated circuit 200 shown in FIG. 1.

Referring to FIG. 2, an embodiment of the display driver integrated circuit 200 may include an interface unit 210, a data processor 220, a memory 230, and a channel unit 240.

The interface unit 210 may function to communicate with the host 400 through a predetermined interface, and receive various signals from the host 400.

The data processor 220 may rearrange data signals supplied via the interface unit 210 based on the resolution of the display panel 100, and store the rearranged data signals to the memory 230.

The data processor 220 may process data stored in the memory 230 in response to an image quality improvement algorithm or a command (e.g., a luminance control command) supplied via the interface unit 210.

The memory 230 may store data. In one embodiment, for example, the memory 230 may be a random access memory ("RAM").

The channel unit 240 may be supplied with data stored in the memory 230. The channel unit 240 supplied with the data stored in the memory 230 may generate a data signal under control of the data processor 220.

In one embodiment, for example, the channel unit 240 may select one of a plurality of gamma voltages as a data signal in response to the bit of data. The data signal generated from the channel unit 240 may be supplied to the data lines D.

Although not shown in FIG. 2, the display driver integrated circuit 200 may further include a voltage generation unit configured to generate a voltage for driving. In one embodiment, for example, the voltage generation unit may generate a gate high voltage and a gate low voltage for driving the scan driver 300 and supply the generated voltages to the scan driver 300. The voltage generation unit may generate an initialization voltage for initializing the pixels PXL and supply the initialization voltage to the display panel 100. In such an embodiment, the voltage generation unit may generate and supply various voltages used to drive the display panel 100.

Figure 3:
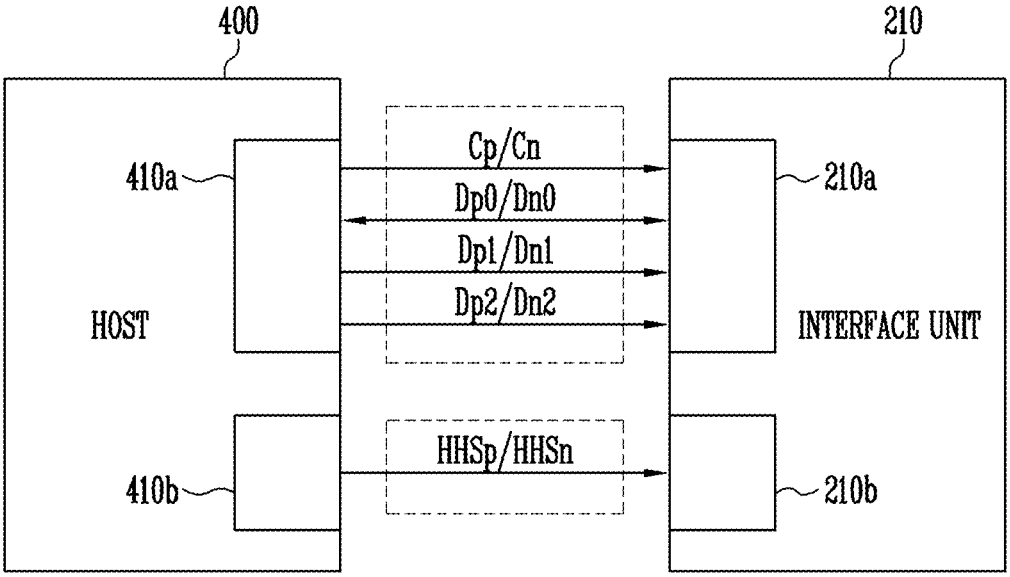
FIG. 3 is a diagram illustrating a communication method between a host and the display driver integrated circuit shown in FIG. 1.

FIG. 3 is a diagram illustrating a communication method between the host 400 and the display driver integrated circuit 200 shown in FIG. 1.

In an embodiment, the host 400 and the display driver integrated circuit 200 may communicate with each other through a first interface and a second interface different from the first interface.

In such an embodiment, the host 400 may include a first transmitting interface unit 410*a* and a second transmitting interface unit 410*b*.

In such an embodiment, the interface unit 210 of the display driver integrated circuit 200 may include a first receiving interface unit 210*a* and a second receiving interface unit 210*b*.

In an embodiment, the first interface may be a mobile industry processor interface ("MIPI"). In such an embodiment, the first transmitting interface unit 410*a* and the first receiving interface unit 210*a* may communicate with each other through the MIPI.

Each of the first transmitting interface unit 410*a* and the first receiving interface unit 210*a* may include a clock lane module (e.g., a single clock lane module) and a data line module (e.g., one or more data line modules).

Each lane module may communicate with a corresponding lane module disposed on an opposite side of a lane interconnection region through two types of interconnection lines Cp/Cn or Dpi/Dni. Here, i is an integer greater than or equal to zero (0).

In one embodiment, for example, the clock lane module may communicate through a pair of first interconnection lines Cp/Cn. The pair of first interconnection lines Cp/Cn may be used for one-way communication from the first transmitting interface unit 410*a* to the first receiving interface unit 210*a*.

In an embodiment where three data lane modules are provided, as shown in FIG. 3, communication may be performed through three pairs of second interconnection lines Dp0/Dn0, Dp1/Dn1 and Dp2/Dn2.

A pair of second interconnection lines Dp0/Dn0 among the three pairs of second interconnection lines Dp0/Dn0, Dp1/Dn1 and Dp2/Dn2 may be used for two-way communication between the first transmitting interface unit 410*a* and the first receiving interface unit 210*a*. The other pairs of second interconnection lines Dp1/Dn1 and Dp2/Dn2 may be used for one-way communication from the first transmitting interface unit 410*a* to the first receiving interface unit 210*a*.

In such an embodiment, the clock lane module and the data lane module that are provided in the first transmitting interface unit 410*a* and the first receiving interface unit 210*a* may comply with the MIPI standards.

Signals to be transmitted from the first transmitting interface unit 410*a* to the first receiving interface unit 210*a* may be data signals corresponding to an image to be displayed on the display panel 100, and a plurality of synchronous signals.

In an embodiment, the data signals may be transmitted through the data lane module, and the synchronous signals may be transmitted through the clock lane module. In such an embodiment, the data signals may be high-speed signals, and the synchronous signals may be low-power signals.

The second transmitting interface unit 410*b* and the second receiving interface unit 210*b* may communicate with each other through the second interface.

In an embodiment, each of the second transmitting interface unit 410*b* and the second receiving interface unit 210*b* may include a metadata lane module.

The metadata lane module included in the second transmitting interface unit 410*b* and the metadata lane module included in the second receiving interface unit 210*b* may communicate with each other through a pair of third interconnection lines HHSp/HHSn.

The pair of third interconnection lines HHSp/HHSn may be used for one-way communication from the second transmitting interface unit 410*b* to the second receiving interface unit 210*b*.

Signals to be transmitted from the second transmitting interface unit 410*b* to the second receiving interface unit 210*b* may be metadata signals.

In an embodiment, the metadata signals may be transmitted in a high-speed mode. However, the disclosure is not limited thereto. The metadata signals may be transmitted in a low-power mode. In an embodiment, the metadata signals may be transmitted in a serial programming interface ("SPI") scheme or an inter-integrated circuit ("I2C") scheme.

In an embodiment, the display device may provide a high dynamic range ("HDR") image display function to display images having high quality.

HDR images may include not only general image data but also metadata. Here, the general image data may be transmitted using the first interface, i.e., the MIPI, and the metadata may be transmitted using the second interface.

The metadata may include set values enabling contents to be correctly displayed. In one embodiment, for example, the metadata may include a set value for tone mapping, a set value for determining a color gamut and remapping colors, a maximum-luminance set value of an image, a minimum-luminance set value of an image, etc.

In a case where only the MIPI for communication between the host 400 and the display driver integrated circuit 200 is used for HDR images including metadata, metadata may not be efficiently transmitted or processed because a metadata type is not defined in the MIPI specifications.

In an embodiment of the invention, the display device may use the interface for transmitting metadata such that the metadata may be efficiently transmitted and processed.

FIG. 3 illustrates an embodiment in which the metadata is transmitted through the second interface between the host 400 and the display driver integrated circuit 200, but the disclosure is not limited thereto. In one alternative embodiment, for example, not only the metadata but other signals that are not defined in the MIPI specifications may also be transmitted through the second interface.

Figure 4:
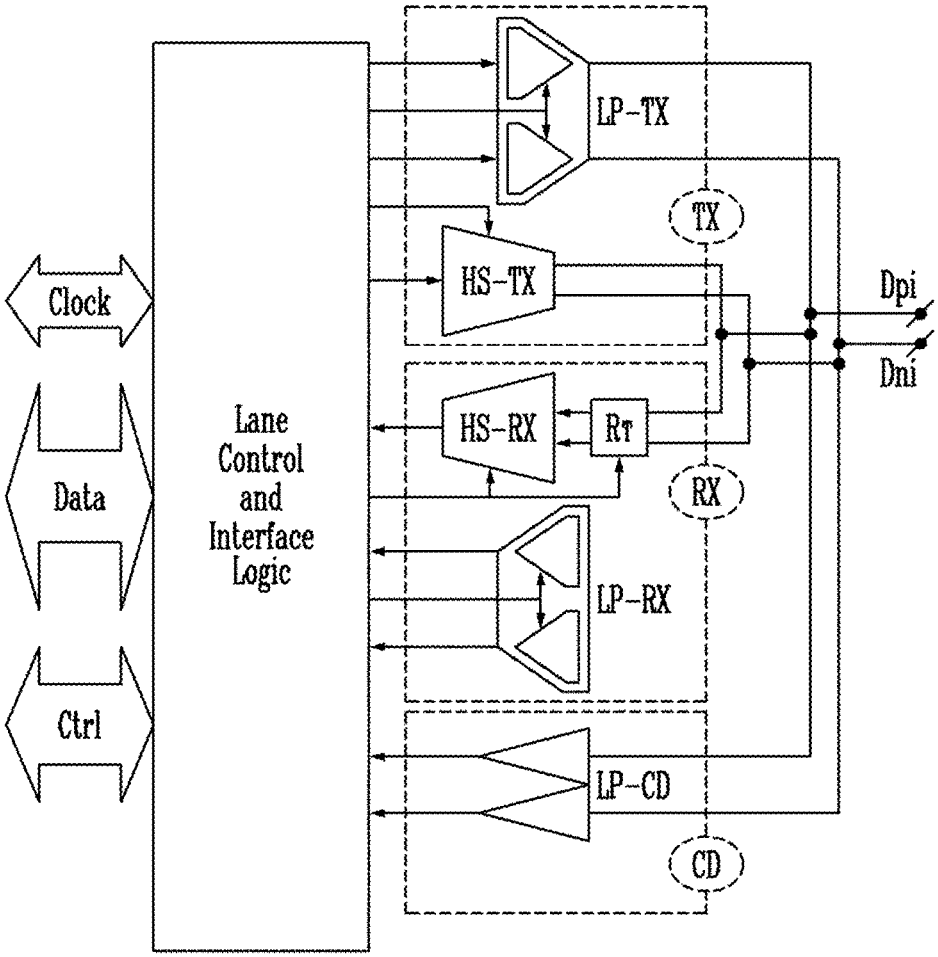
FIG. 4 is a diagram illustrating functions of a universal lane module of a mobile display digital interface ("MIPI") in accordance with an embodiment of the disclosure.

FIG. 4 is a diagram illustrating functions of a universal lane module of the MIPI in accordance with an embodiment of the disclosure. FIG. 4 illustrates the configuration of a single lane module having overall functions.

Referring to FIG. 4, an embodiment of a lane module may include a lane control-and-interface logic and an input/output unit TX, RX, and CD.

The input/output unit TX, RX, and CD may include a high-speed transmitter HS-TX, a high-speed receiver HS-RX, a low-power transmitter LP-TX, a low-power receiver LP-RX, and a low-power contention detector LP-CD.

In such an embodiment, a transmitter TX of the input/output unit TX, RX, and CD may include the low-power transmitter LP-TX and the high-speed transmitter HS-TX. A receiver RX of the input/output unit TX, RX and CD may include the high-speed receiver HS-RX, the low-power receiver LP-RX, and a termination resistor (termination impedance) $R_T$. A contention detector CD of the input/output unit TX, RX and CD may include the low-power contention detector LP-CD. In such an embodiment, only when each lane module is in the high-speed receiving mode, the termination resistor $R_T$ may be enabled.

High signals may have a low-voltage swing of, e.g., 200 millivolts (mV), while low-power signals may have a high-voltage swing of, e.g., 1.2 volts (V).

The high-speed transmitter HS-TX and the high-speed receiver HS-RX may be mainly used for high-speed data transmission. The low-power transmitter LP-TX, the low-power receiver LP-RX and the low-power contention detector LP-CD may be mainly used for control and also selectively used in other cases.

In an embodiment, each lane module may include either the high-speed transmitter HS-TX or the high-speed receiver HS-RX, or both. In an embodiment, where each lane module includes both of the high-speed transmitter HS-TX and the high-speed receiver HS-RX, the high-speed transmitter HS-TX and the high-speed receiver HS-RX may not be simultaneously enabled.

In an embodiment where the lane module includes the high-speed transmitter HS-TX, the low-power transmitter LP-TX may also be included in the lane module. In an embodiment where the lane module includes the high-speed receiver HS-RX, the low-power receiver LP-RX may also be included in the lane module. The low-power contention detector LP-CD may be used for only both-way operation. The low-power contention detector LP-CD may be enabled to detect contention only when the low-power transmitter LP-TX is operated.

Such input/output functions may be controlled by the lane control-and-interface logic. The lane control-and-interface logic may interface with a protocol layer and determine a global operation of the lane module.

Figure 5:
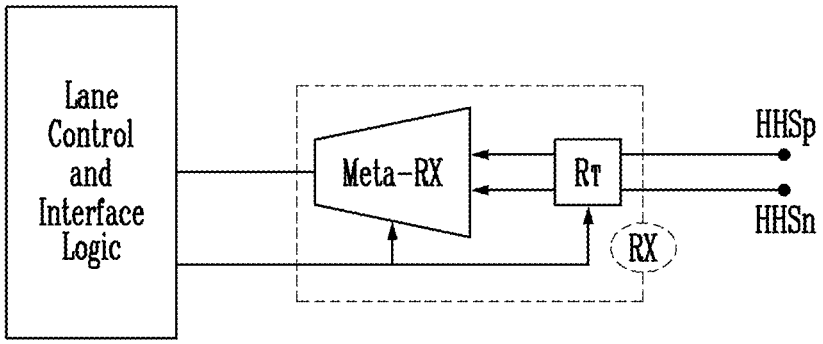
FIG. 5 is a diagram illustrating the function of a metadata lane module in accordance with an embodiment of the disclosure.

FIG. 5 is a diagram illustrating the function of the metadata lane provided in the display driver integrated circuit.

Referring to FIG. 5, an embodiment of the metadata lane module may include a lane control-and-interface logic and a receiver RX.

The receiver RX may include a metadata receiver Meta-RX and a termination resistor $R_T$. The metadata receiver Meta-RX may be a high-speed receiver or a low-power receiver.

In an embodiment, as shown in FIG. 5, the receiver RX includes a single metadata receiver Meta-RX which may be either the high-speed receiver or the low-power receiver, but the disclosure is not limited thereto. In one embodiment, for example, a plurality of metadata receivers Meta-RX may be included in the receiver RX, and each metadata receiver Meta-RX may be a high-speed receiver or a low-power receiver.

Only when the metadata lane module is in a high-speed receiving mode, the termination resistor $R_T$ may be enabled.

The functions of the metadata receiver Meta-RX and the termination resistor $R_T$ may be controlled by the lane control-and-interface logic.

In accordance with embodiments of the disclosure, the display quality of images may be enhanced by improving a communication function between a host and a display driver integrated circuit provided in a display device.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

a host which transmits high dynamic range image data through a first interface and a second interface; and a display driver integrated circuit comprising:

a first interface unit which receives a first signal of the high dynamic range image data through the first interface; and a second interface unit which receives a second signal of the high dynamic range image data through the second interface, the second interface being different from the first interface, wherein the second signal includes metadata of the high dynamic range image data which is not defined in a mobile industry processor interface scheme, wherein the display driver integrated circuit receives the high dynamic range image data from the host, wherein the first interface is a mobile industry processor interface, and wherein the second signal includes at least one of a set value for tone mapping, a set value for determining a color gamut and remapping colors, a maximum-luminance set value of an image, and a minimum-luminance set value of an image.

2. The display device according to claim 1, further comprising:

a display panel which receives a signal corresponding to the first signal and the second signal from the display driver integrated circuit, and displays an image.

3. The display device according to claim 1, wherein the first interface unit comprises:

a clock lane module which receives the clock signal; and a data lane module which receives the data signal.

4. The display device according to claim 3, wherein the second interface unit comprises a metadata lane module which receives the metadata.

5. The display device according to claim 4, wherein the metadata lane module comprises a high-speed receiver.

6. The display device according to claim 4, wherein the metadata lane module comprises a low-power receiver.

7. The display device according to claim 1, wherein the second interface is operated in a serial programming interface scheme.

8. The display device according to claim 1, wherein the second interface is operated in an inter integrated circuit scheme.

9. The display device according to claim 1, wherein the host transmits data different from the metadata among the high dynamic range image data through the first interface.

10. The display device according to claim 1, wherein the first signal includes a data signal and a clock signal.

11. The display device according to claim 10, wherein the host generates and outputs the first signal for driving the display driver integrated circuit.

12. A display driver integrated circuit comprising:

a first interface unit which receives a first signal of high dynamic range image data from a host in a mobile industry processor interface scheme; and a second interface unit which receives a second signal of the high dynamic range image data from the host in an interface scheme different from the mobile industry processor interface scheme, wherein the second signal includes metadata of the high dynamic range image data which is not defined in the mobile industry processor interface scheme, and wherein the second signal includes at least one of a set value for tone mapping, a set value for determining a color gamut and remapping colors, a maximum-luminance set value of an image, and a minimum-luminance set value of an image.

13. The display driver integrated circuit according to claim 12, wherein the first interface unit comprises:

a clock lane module which receives the clock signal; and a data lane module which receives the data signal, and wherein the second interface unit comprises a metadata lane module which receives the metadata.

14. The display driver integrated circuit according to claim 13, wherein the metadata lane module comprises a high-speed receiver.

15. The display driver integrated circuit according to claim 13, wherein the metadata lane module comprises a low-power receiver.

16. The display driver integrated circuit according to claim 12, wherein the first interface unit receives remaining data other than the metadata among the high dynamic range image data.

17. The display driver integrated circuit according to claim 12, wherein the host transmits data different from the metadata among the high dynamic range image data through the mobile industry processor interface scheme.

18. The display driver integrated circuit according to claim 12, wherein the first signal includes a data signal and a clock signal.

19. The display driver integrated circuit according to claim 18, wherein the host generates and outputs the first signal for driving the display driver integrated circuit.

* * * * *